US005413021A

United States Patent [19]

Margetson

[11] Patent Number: 5,413,021

[45] Date of Patent: May 9, 1995

[54] TACTILE CHROMATIC HARMONICA

[76] Inventor: Desmond W. Margetson, 515 W. 122 St., New York, N.Y. 10027

[21] Appl. No.: 247,096

[22] Filed: May 20, 1994

[51] Int. Cl.[6] ..... G10D 7/12

[52] U.S. Cl. ..... 84/377

[58] Field of Search ..... 84/377, 378

[56] References Cited

U.S. PATENT DOCUMENTS 1,851,639 3/1932 Miles ..... 84/377

3,674,910 7/1972 McKenzie ..... 84/377

4,237,766 12/1980 Marshall ..... 84/377

5,166,461 11/1992 Salwitz et al. ..... 84/377

*Primary Examiner*—M. C. Gellner

*Assistant Examiner*—Patrick J. Stanzione

*Attorney, Agent, or Firm*—Bierman and Muserlian

[57] ABSTRACT

A chromatic harmonica in which the upper register blow-note of a lower octave, and an adjacent, lower register blow-note of an upper octave are identical, repeating notes, and cavities corresponding to these repeating notes are separated by a tactile divider.

7 Claims, 1 Drawing Sheet

TACTILE CHROMATIC HARMONICA

The present invention is directed to a chromatic harmonica, and more specifically, to a harmonica in which cavity sets, containing blow-reeds for forming an identical scale in one of a plurality of octaves are adjacent to cavity sets corresponding to at least one of a higher and lower octave, the blow-note of the final cavity of the cavity set being a repeating note identical to that formed by the first cavity of the adjacent, higher octave cavity set, there being provided between the cavities forming the repeating note, a tactile divider for determining which of the adjacent cavities forming the repeating blow-note is being played.

BACKGROUND OF THE INVENTION

Chromatic harmonicas comprise a body having provided therein a series of adjacent cavities, each containing a plurality of reeds which are adapted to produce a musical note of a predetermined pitch upon passage of air thereover. Each cavity has a pair of corresponding reeds including a blow-reed, which produces a blow-note responsive to the blowing of air into the cavity, and a draw-reed, which produces a draw-note responsive to the drawing of air from the cavity. The harmonica further includes a slide key which, when activated, raises the pitch of the note formed by each reed, by a half tone (to the sharp).

The cavities of the harmonica are arranged in cavity sets, each of which represents an identical scale in one of a plurality of octaves. The blow-note of the final cavity of each cavity set forms the blow-note of the first cavity of that cavity set, raised one octave. Each cavity set is adjacent to a cavity set corresponding to at least one of a higher and lower octave, the cavity sets being arranged sequentially and progressing from lower to higher octaves from left to right with respect to the playing position. In harmonicas of this type the scale note of the harmonica is always formed by a blow reed. However, as the scale contains only seven whole notes, assuming the lower scale note is a draw-note, the upper scale note for each cavity set would normally be a draw-note. To prevent this, the position of the two reeds of the final cavity of the cavity set are reversed. More concretely, in a C-scale cavity set, the blow-notes should be, in sequence, C, E, G, B and the draw-notes should be D, F, A, C, and to prevent the high C from being a draw-note the position of the reeds for the B and high C are reversed. As a by-product of this reversal, however, the blow-note of the final cavity of the cavity set is a repeating note, identical to the blow-note formed by the first cavity of the adjacent, higher octave set.

During play, one often loses track of which of the two adjacent cavities is to be played. Such is not critical when a blow-note is desired, as the same blow-note is formed by the blow-reeds of each of the adjacent cavities. However, when one is required to play a specific draw-note related to the duplicated blow-note, it is imperative that one be aware of which cavity is to be activated, as the draw-notes of the adjacent cavities are not identical. While this problem may not affect the skilled artisan, it may prevent the novice from quickly learning the instrument. Thus, it would be advantageous, to provide a means for allowing the less experienced player to differentiate between these adjacent cavities, therefore providing for an accelerated mastering of the instrument.

BRIEF DESCRIPTION OF THE INVENTION

In view of the foregoing, it is an object of the present invention to provide a chromatic harmonica in which one is able to positively determine which of two adjacent cavities, forming repeating blow-notes, are to be played by providing a reference marker for the associated draw-notes.

Other objects and features of the present invention will become apparent from the following detailed description, considered in conjunction with the accompanying drawings.

DETAILED DESCRIPTION OF THE INVENTION

Figure 1A:
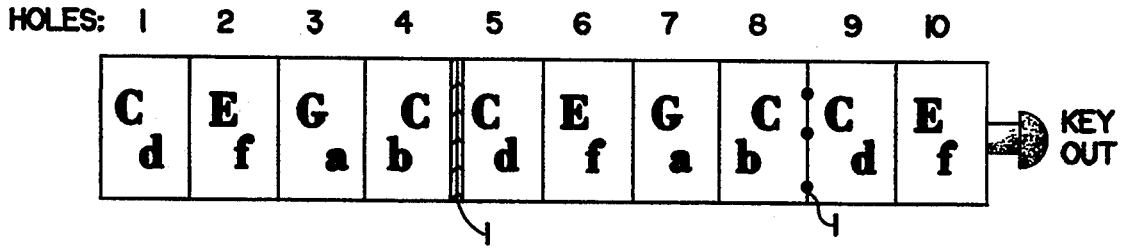
FIG. 1*a* schematically illustrates the note arrangement of a ten-cavity, C-scale chromatic harmonica with the slide key deactivated, demonstrating the placement of the inventive dividers.

The chromatic harmonica of the invention, like a standard chromatic harmonica, includes a body having provided therein a series of adjacent cavities, and a plurality of reeds, each of the reeds being adapted to produce a musical note of a predetermined pitch upon passage of air thereover. Each cavity is supplied with a pair of corresponding reeds, including a blow-reed which produces a blow-note responsive to the blowing of air into the cavity, and a draw-reed, which produces a draw-note responsive to the drawing of air from the cavity. The harmonica further comprises a slide key which, when activated, raises the pitch of the note formed by each reed, by a half tone.

Figure 1B:
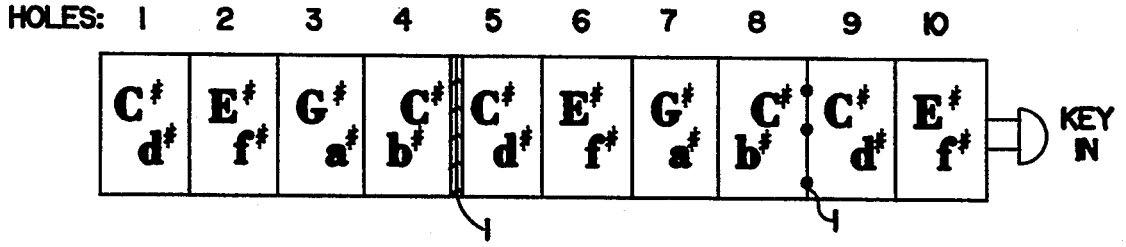
FIG. 1*b* schematically shows the note arrangement of the harmonica of FIG. 1*a*, with the slide key activated.

Turning now to FIG. 1*a*, there is shown the note arrangement of a C-scale chromatic harmonica, with the slide key deactivated. Upper case letters set forth therein designate blow-notes, while the lower case letters designate draw-notes, for each cavity of the harmonica. FIG. 1*b* illustrates the note arrangement of a C-scale, ten note harmonica, with the slide key activated. In this mode, the pitch of each note is raised by a half tone, to the sharp. Thus, for a ten cavity harmonica, 40 notes can be produced. Eight, ten, twelve, and sixteen cavity harmonicas are all common, and with each, the number of notes available is equal to four times the number of cavities.

As is clear from the figures, the cavities are arranged in sequential cavity sets, each cavity set from left to right representing an identical scale in one of a plurality of successively higher octaves. Each cavity set is adjacent to a cavity set corresponding to at least one of a higher octave or a lower octave and, for each octave, the blow-note of the final cavity is the blow note of the first cavity, raised one octave.

As is further apparent from the figures, the blow-note of the final cavity of each cavity set is a repeating note, identical to the blow-note formed by a first cavity of the adjacent, higher octave cavity set. The invention is specifically directed to this feature of the chromatic harmonica.

It was noted by the Inventor that the repeating notes were oftentimes mistaken for one another. Such is not a problem, when only the blow-note is considered as both blow-notes will be identical. If one's intent is to form a draw-note, however, and it is not remembered which of the two adjacent cavities is to be activated, an incorrect note can be played. For example, with two adjacent C blow-note cavities, one must differentiate between B and D draw-notes. To solve the foregoing problem, the invention is directed to reference tactile divider 1 placed between the cavities corresponding to the repeating blow-notes. Placement thereof is shown in the accompanying FIG. 1*a*. This tactile divider 1 can include, for example, a small raised divider, or at least one raised stud, on the harmonica body. The divider 1, separating the two adjacent cavities acts like a fret on a guitar, in principle. More specifically, the tactile divider allows the tongue and/or lips of the artist to sense which of the two adjacent cavities is to be selected, based on which side of the divider the cavity is positioned. Such a system operates in the same manner whether the player moves relative to the harmonica, or whether the harmonica is moved relative to the player. Either way, the desired note can be selected with certainty.

Most preferably, divider 1 is formed as a permanent, integral part of the body, by stamping, pressing, casting, molding, or other similar means. In addition, temporary dividers, which can be removed from the harmonica, are also possible. Each such embodiment would operate under the same basic premise. The dividers, of course, should not be abrasive to the tongue or lips of the player.

It is noted that, while the foregoing description has been directed to a C-scale harmonica, the invention would operate in the same manner on other scale harmonicas. It is noted that the repeating note is the same as the note designating the scale of the harmonica. For example, in a C-scale harmonica, the high C of the lower register octave will be repeated as the low C of the higher scale octave, with reference to the blow-note. Similarly, in an A-scale harmonica, the high pitch A blow-note of the lower octave will be repeated as the low pitch A blow-note of the higher, adjacent octave.

While only the fundamental novel features of the invention as applied to a preferred embodiment thereof have been shown and described, it is understood that various omissions, substitutions, and changes in the form and details in the device illustrated and in its operation may be made by those skilled in the art without departing from the spirit of the invention. It is therefore the intention of Applicant that the invention be limited only as indicated by the scope of the claims appended hereto.

I claim:

1. In a chromatic harmonica comprising a body having provided therein a series of adjacent cavities and a plurality of reeds, each of said reeds being adapted to produce a musical note of a predetermined pitch upon passage of air thereover, wherein each cavity has a pair of corresponding reeds, including a blow-reed which produces a blow-note responsive to the blowing of air into said cavity, and a draw-reed which produces a draw-note responsive to the drawing of air from said cavity, said harmonica further comprising a slide key which, when activated, raises the pitch of the note formed by each reed by a half tone, said cavities being arranged in a sequentially arranged cavity set, each of said cavity set representing an identical scale in one of a plurality of octaves, a blow note of a final cavity of each cavity set forming the blow note of the first cavity thereof, raised by one octave, each cavity set being adjacent to a cavity set corresponding to at least one of a higher and lower octave, the blow note of a final cavity of said cavity set being a repeating note, identical to that formed by a first cavity of an adjacent, higher octave cavity set, said cavities each terminating at one end to form a planar playing surface, the improvement comprising placement of at least one tactile divider between at least two adjacent blow-holes corresponding to said repeating notes comprising a highest note of a first cavity set, and a lowest note of an adjacent cavity set, set tactile divider projecting from said playing surface in a direction opposite said cavities.

2. The harmonica of claim 1 wherein said tactile divider is formed integrally with said body.

3. The harmonica of claim 1 wherein said dividers are removable.

4. The harmonica of claim 1 wherein said dividers are formed by one method selected from the group consisting of stamping, pressing, casting, and molding.

5. The harmonica of claim 1 wherein said divider comprises at least one raised stud.

6. The harmonica of claim 1 wherein said harmonica is a C-scale harmonica, and said repeating note is a C.

7. The harmonica of claim 1 wherein said harmonica is an A-scale harmonica, and said repeating note is an A.

* * * * *